US007584745B2

(12) United States Patent
Ross, Jr.

(10) Patent No.: US 7,584,745 B2
(45) Date of Patent: Sep. 8, 2009

(54) CARBURETOR ELECTRONIC FUEL INJECTION PLENUM

(76) Inventor: Thomas Ross, Jr., 909 Hilltop Ave., Abingdon, MD (US) 21009

( * ) Notice: Subject to any disclaimer, the term of this patent is extended or adjusted under 35 U.S.C. 154(b) by 0 days.

(21) Appl. No.: 12/290,098

(22) Filed: Oct. 27, 2008

(65) Prior Publication Data

US 2009/0107459 A1 Apr. 30, 2009

Related U.S. Application Data

(60) Provisional application No. 61/000,369, filed on Oct. 25, 2008.

(51) Int. Cl.
*F02M 25/07* (2006.01)

(52) U.S. Cl. ..... 123/437; 123/472

(58) Field of Classification Search ..... 123/437, 123/472, 538; 261/40, DIG. 39
See application file for complete search history.

(56) References Cited

U.S. PATENT DOCUMENTS 4,253,441 A * 3/1981 Kawamura et al. ..... 123/445
4,313,411 A * 2/1982 Moriyama et al. ..... 123/445
4,327,675 A * 5/1982 Takeda ..... 123/470
4,406,259 A * 9/1983 Van Etten ..... 123/198 R
4,946,631 A * 8/1990 Buford ..... 261/39.5
5,009,681 A * 4/1991 Jochum ..... 55/416

* cited by examiner

*Primary Examiner*—Stephen K Cronin
*Assistant Examiner*—David Hamaoui
(74) *Attorney, Agent, or Firm*—Ober/Kaler; Royal W. Craig

(57) ABSTRACT

A injection conversion body with internal injector compartment for converting a normally carbureted internal combustion engine to a fuel injected engine while concealing the fuel delivery system. The original engine carburetor is removed. The plenum assembly is mated to the original engine intake manifold and a suitable throttle body is mated to the intake apertures which are oriented to permit installation without modification to the vehicle body work or relocation of other engine components. Air drawn through the throttle body is mixed with fuel from fuel injectors inside the plenum as it is directed to and exits the fuel air exhaust opening and enters the engine intake manifold. Interchangeable restriction plates are provided for insertion into the plenum fuel air exhaust opening to tune the fuel/air mixing characteristics to match the needs of the engine with which it is mated. Fuel is delivered to the fuel injectors through an internal, concealed fuel rail and fuel lines.

9 Claims, 6 Drawing Sheets

CARBURETOR ELECTRONIC FUEL INJECTION PLENUM

CROSS-REFERENCE TO RELATED APPLICATIONS

The present application derives priority from provisional application 61/000,369 filed on Oct. 25, 2007 which is incorporated herein by reference.

BACKGROUND OF THE INVENTION

1. Field of the Invention

The present invention relates to aftermarket customization of automobile or other internal combustion engines in order to increase control, power output and efficiency of the engine while maintaining or improving the aesthetic appearance of the engine mechanics. More particularly, the present invention relates to a system for converting the fuel/air supply system of an internal combustion engine from a carbureted system to a fuel injector system while simultaneously concealing the mechanics of the conversion to maintain a desirable appearance.

2. Description of the Background

The aftermarket for performance and specialty auto parts provides consumers with the ability to customize their vehicle to suite their tastes and needs. Cars can be customized to improve performance, aesthetics, efficiency, emissions or other reasons and are often judged in shows and at racing events on these criteria. The increasing cost of fuel is generally of concern to all drivers. One way that manufacturers have improved the power, performance and efficiency of internal combustion engines is by replacing the mechanical carburetor system of mixing fuel and engine intake air with a fuel injection system. Fuel injection systems use electronically controlled fuel injectors to deliver a precisely metered amount of fuel to the engine at controlled intervals and provide significantly better control of the fuel/air mixture thereby increasing both performance and efficiency.

Although designs vary widely, all carburetors operate on the same design principals. Air is drawn into the engine via an air filter housing and then the carburetor by the pumping action of the pistons. As the air enters the top of the carburetor it passes a venturi or restriction in the throttle bore causing the air to speed up and resulting in a drop in total pressure. This pressure drop pulls fuel from a reservoir or float bowl through a jet and into the throttle bore where it is mixed with the intake air and distributed by the intake manifold and drawn into the cylinders via the cylinder intake ports.

Fuel injection fuel delivery systems replace the float bowl and jets of the carburetor with electronically controlled injectors. The injectors spray a fine mist of fuel from a high pressure fuel supply into the engine air under the timing and control of an electronic system. The position of the injectors in the system varies. Some systems place the injectors in the throttle body, referred to as single point fuel injection systems or throttle body fuel injection (TBI), while other systems incorporate the injectors into the intake manifold and inject the fuel spray directly into each cylinder intake port. Referred to as multi-port fuel injection, or tuned-port (TPI) fuel injection, these systems have a fuel injector for each cylinder and provide more accurate fuel metering and quicker response and provides greater engine control, but require an intake manifold and engine specifically designed for this purpose.

Most recently direct injection systems have been developed in which the injector delivers the fuel spray into the cylinder combustion chamber directly. Gasoline direct injection entails injection via a common rail fuel line directly into the combustion chamber of each cylinder, as opposed to conventional fuel injection that happens in the intake tract, or cylinder port.

Many car enthusiasts are particularly interested in racing and showing vintage vehicles that were originally built before the widespread implementation of fuel injected engines and which are thus powered by carbureted engines. Converting an older carbureted engine to a fuel injected system is challenging due to the need to incorporate the injectors, fuel pressure regulator, fuel supply rails and electronic control components into an engine that was not originally designed to have them, and to do so within a vehicle engine bay that was not designed to accommodate the additional parts. Conversion generally requires disassembly of a substantial portion of the engine including the air intake manifold provided by the original manufacturer. The primary function of the air intake manifold is to evenly distribute the combustion fuel/air mixture to each intake port in the cylinder heads. The intake manifold also serves as a mount for the air filter, carburetor or throttle body, and other components of the engine. Conversion entails removal of each of these components and replacement with a fuel injection system. This work is often beyond the skill or resources of vehicle owners.

Vehicle owners have a variety of commercial conversion kits available for purchase. Such kits are patched together from disparate and custom parts and, while generally functional, drastically change the "under-the-hood" and coachwork aesthetics of the vehicle and so are generally unsuitable for display in auto shows and judged competitions. Vintage car owners want their cars to appear true to their era, while being as technologically modern as possible. These home-built or kit systems also suffer from an inability to modify air flow and fuel delivery characteristics to match the needs of the particular engine once installed leading to poor engine performance and low efficiency. If a home built system does not perform well it must be removed and redesigned from the ground up, sometimes repeatedly, to match the fuel and air needs of the engine. In many vintage vehicles, conversion to a fuel injector system is altogether impossible given the geometry of various engine bays and other components.

It would be greatly advantageous to provide a carbureted-to-fuel injection conversion that does not also require replacement of significant engine components such as the intake manifold. It would be further advantageous to provide a carbureted-to-fuel injection conversion having tunable airflow characteristics, that is adaptable to the engine geometry of a variety of vintage vehicles and that conceals the fuel supply and other components of the system to preserve, to a large degree, the aesthetics of the engine.

SUMMARY OF THE INVENTION

Accordingly, it is an object of the present invention to provide a device that enables the user to convert a vehicle's carbureted internal combustion engine to run on an electronic fuel injection system.

It is another object of the present invention to provide a device for fuel injection conversion that conceals the fuel system components including the fuel injectors, fuel rails, engine control computer, wiring and other additional components from view so as to allow the vehicle to be entered into judged car competitions.

It is another object to provide a device for fuel injection conversion that is appropriately configured to allow implementation in the cramped or otherwise closely confined engine compartments of a large number of classic and vintage cars commonly modified for use in the aftermarket performance and show car community.

It is yet another object of the present invention to provide a device for fuel injection conversion that provides for tunable airflow characteristics to match the needs of the engine.

According to the present invention, the above-described and other objects are accomplished by providing a carburetor fuel injector plenum for direct engagement with an engine intake manifold and which internally houses the injectors and fuel rail in a concealed manner and which permits the insertion of airflow restrictor plates to tune the fuel/air delivery characteristics of the device.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 2:
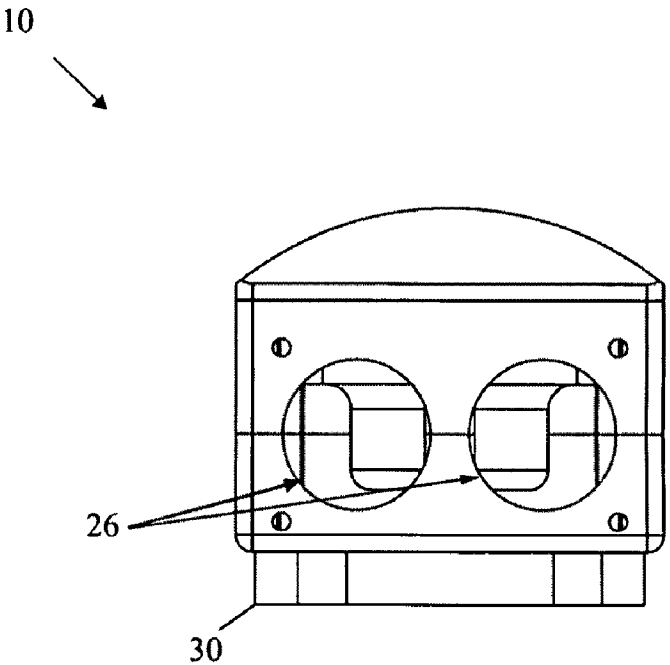
FIG. 2 is a front view of a fuel injection conversion body.
Figure 1:
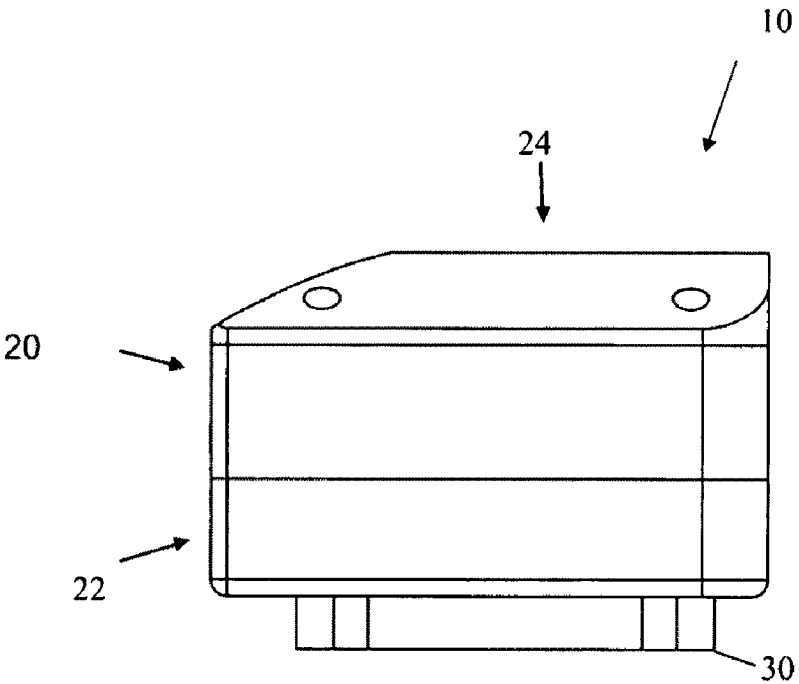
FIG. 1 is a side view of a fuel injection conversion body according to the present invention.
Figure 3:
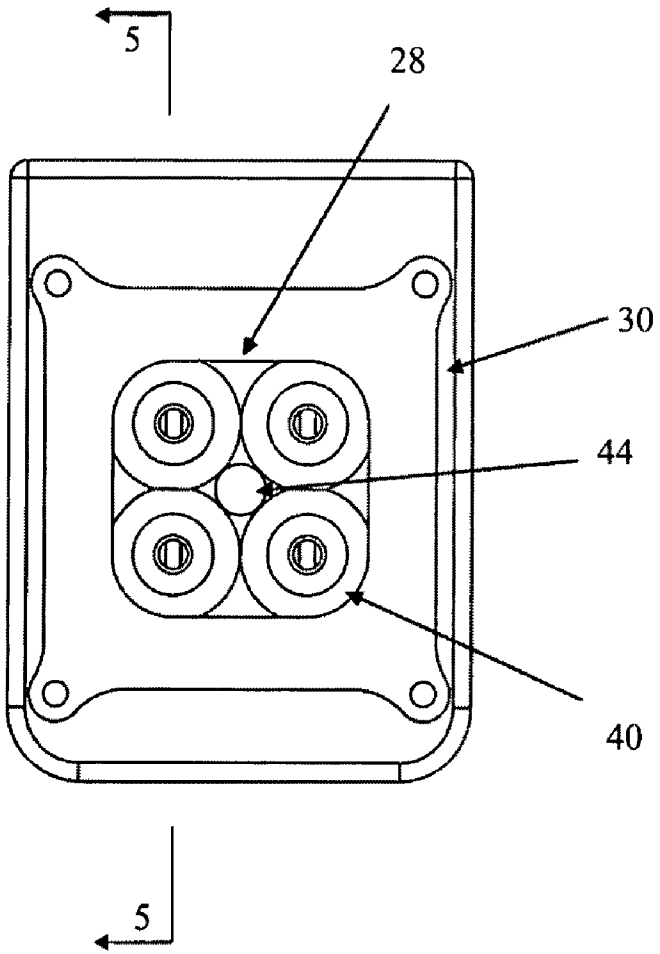
FIG. 3 is a bottom view of a fuel injection conversion body without the insert in place.
Figure 10:
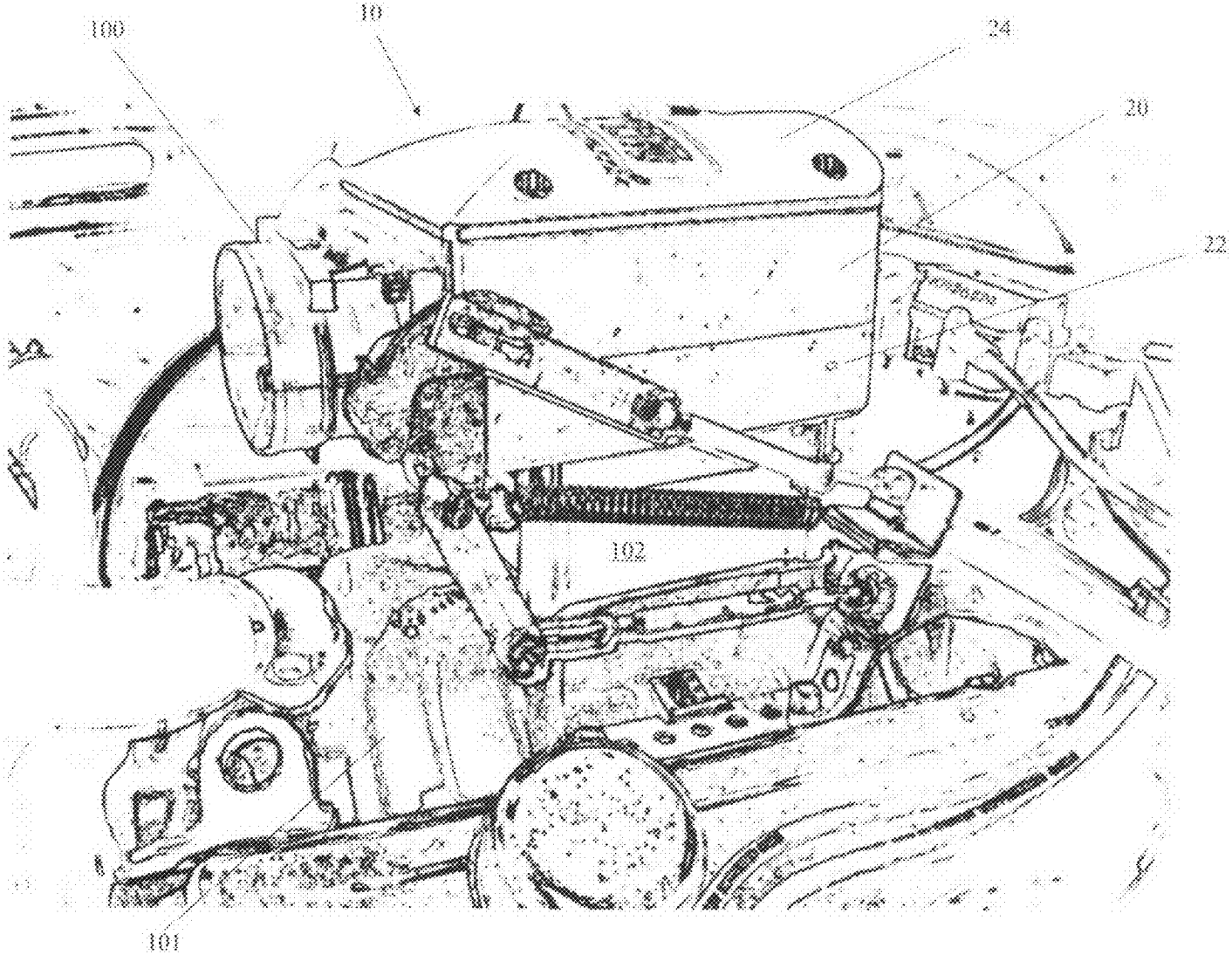
FIG. 10 is a perspective view of a fuel injection conversion body mounted on an intake manifold within the engine bay of an automobile.

The present invention is a fuel injection conversion body 10 for facilitating the conversion of a previously carbureted engine to run on a fuel injected fuel/air mixing system utilizing concealed fuel supply and engine control components to maintain engine compartment and vehicle aesthetics. FIGS. 1, 2 and 3 depict side, front and bottom views of the injection conversion body 10 respectively. FIG. 10 depicts a three-quarters perspective view of the injection conversion body 10 installed on intake manifold 101 of a suitable engine. With combined reference to FIGS. 1, 2, 3 and 10, a fuel injection conversion body 10 is depicted having an upper housing 20, lower housing 22, cover plate 24, and manifold adapter flange 30. The upper housing 20 and lower housing 22 collectively define an air intake aperture 26 and internal plenum 11 (described below and seen in FIG. 5) for the metered ducting of intake air to the intake manifold 101 of a previously carbureted internal combustion engine. The lower housing 22 is configured for sealing engagement directly to the intake of an existing engine intake manifold via manifold adapter flange 30 without need to remove or modify the existing intake manifold.

Attachment of the lower housing 22 to the intake manifold is preferably accomplished by providing a bolt pattern in an integrally formed manifold adapter flange 30 underneath the lower housing 22, the manifold adapter flange 30 having a bolt pattern corresponding to the existing bolt pattern of the manifold to which it is to be joined. To facilitate greater applicability the manifold adapter flange 30 may be provided with bolt hole patterns corresponding to multiple known engine manifold patterns or with elongate bolt holes capable of matching multiple manifold patterns. Alternately, an adapter plate 102 (see FIG. 10) may be used between the manifold adapter flange 30 and the engine intake manifold. The adapter plate may also be used as a spacer or riser to raise the fuel injection conversion body 10 over the manifold for clearance over other components of the engine.

Figure 5:
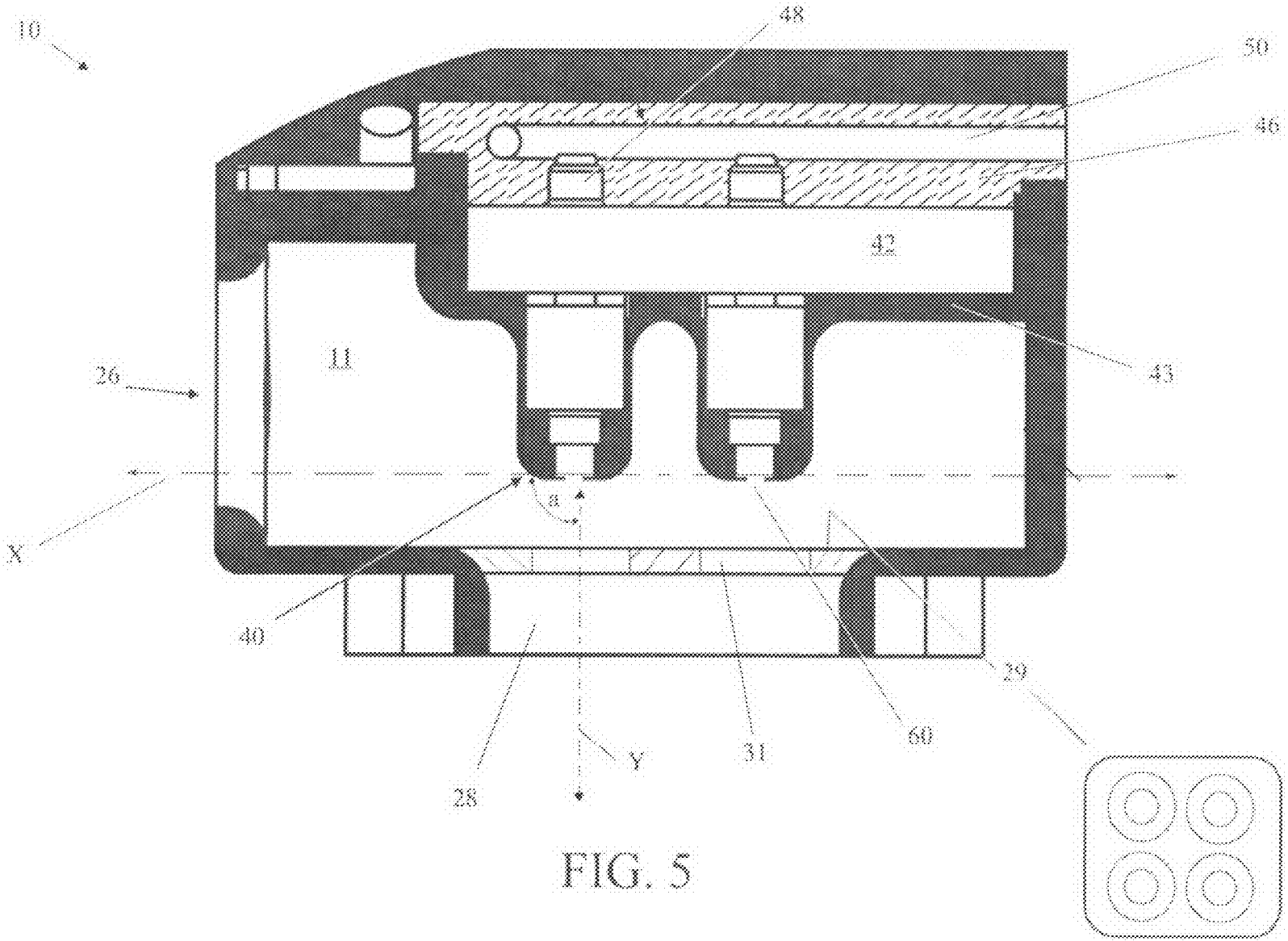
FIG. 5 is a sectional view of a fuel injection conversion body along cut line 5-5 as seen on FIG. 3.
Figure 9:
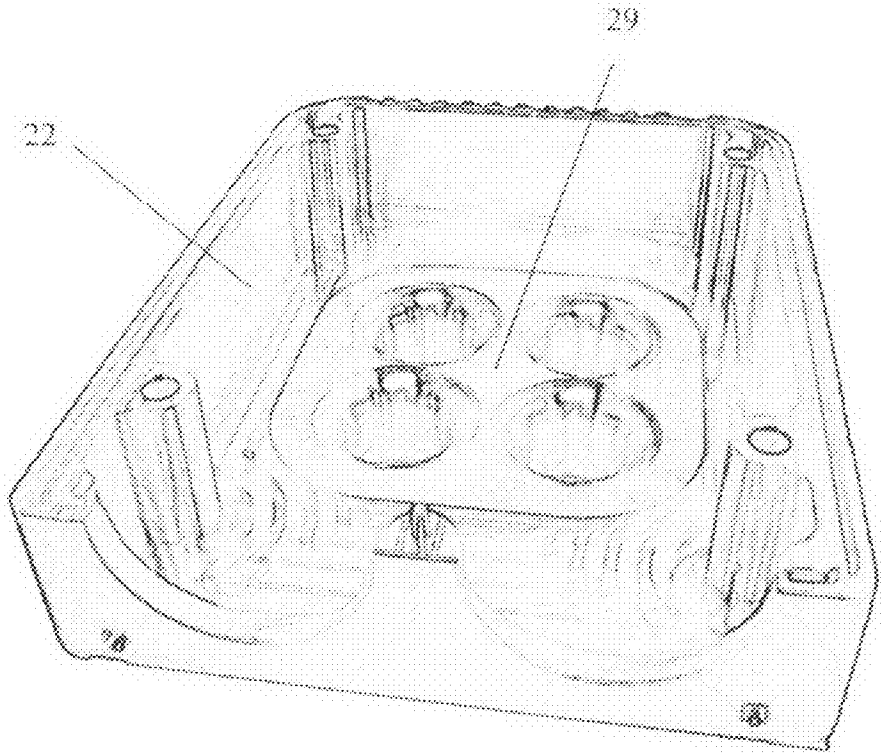
FIG. 9 is a perspective view of an exhaust aperture insert in conjunction with the lower housing.
Figure 8:
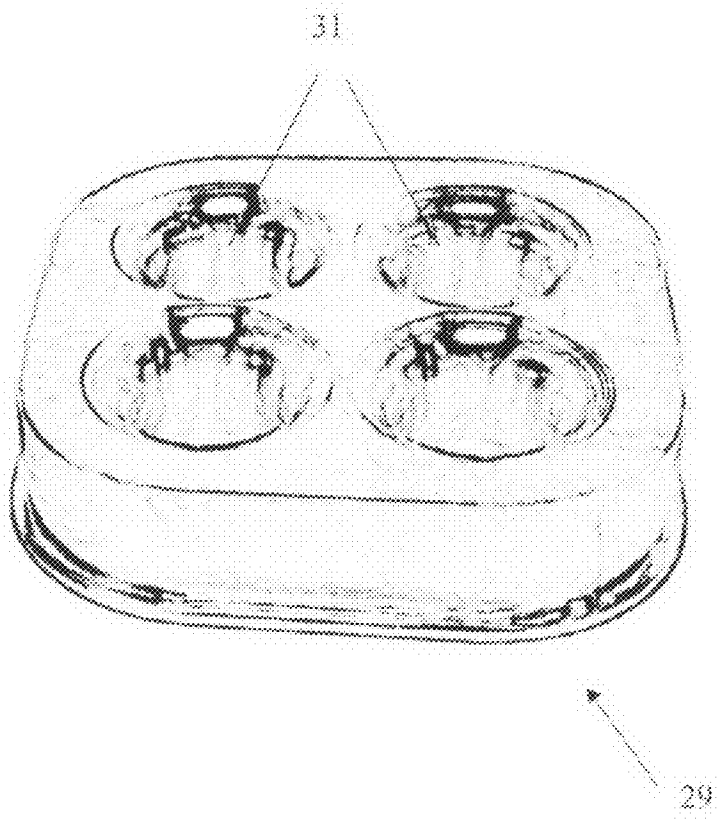
FIG. 8 is a perspective view of an exhaust aperture insert.

As seen in FIGS. 3 and 5, a plenum exhaust aperture 28 is provided through the bottom of the lower housing 22 and through the adapter flange 30 for fluid engagement of the internal plenum 11 with the engine intake manifold. The exhaust aperture 28 may be a single opening corresponding in size with the manifold intake. Improved performance is experienced by restricting the exhaust aperture area thereby altering air velocity, flow volume, pressure and fuel/air mixing on an injector pulse event. Restriction of the exhaust aperture area is preferable accomplished by providing one of a plurality of interchangeable exhaust aperture inserts 29 (see FIGS. 8 and 9) that may be removed or replaced depending on the needs of the engine (as further described below).

With reference to FIG. 5, restriction plate 29 is provided to alter the flow characteristics of air as it passes from the injection conversion body 10 to the engine intake manifold via the exhaust aperture 28. It is contemplated that a variety of restriction plates 29 will be available for use with an injection conversion body 10 according to the present invention so that the installer can tailor the fuel air mixture entering the engine to the requirements of that engine. In the depicted embodiment the restriction plate 29 is formed to seal off the exhaust aperture 28 save for 4 flared cylindrical exhaust ports 31 (FIG. 8) in alignment with the 4 injectors of the present invention. Restriction of the airflow in this manner increases the velocity of the air through the ports 31. Coupled with the axial orientation and alignment of the injectors/exhaust aperture 28, this velocity increase promotes better fuel/air mixing within the intake manifold. Poor fuel/air mixing can result in a richer fuel/air mix in the center cylinders and a lean mixture in the end cylinders reducing potential torque and engine smoothness. Uniform fuel/air mixing produced by the present invention eliminates this problem, particularly at part throttle.

Restriction plate 29 may also be designed with a single central exhaust port, an alternate number of ports corresponding to an alternate number of fuel injectors, conical ports, ports having a non round profile and vaned ports. Most importantly, and most commonly, the diameter of the exhaust ports in the restriction plates depicted will be altered to match the air need of engine across its operating range. In an alternate embodiment, the diameter of exhaust ports 31 may be further reduced by individual cylindrical inserts to permit fine tuning without removing or replacing he entire restriction plate 29.

Figure 6:
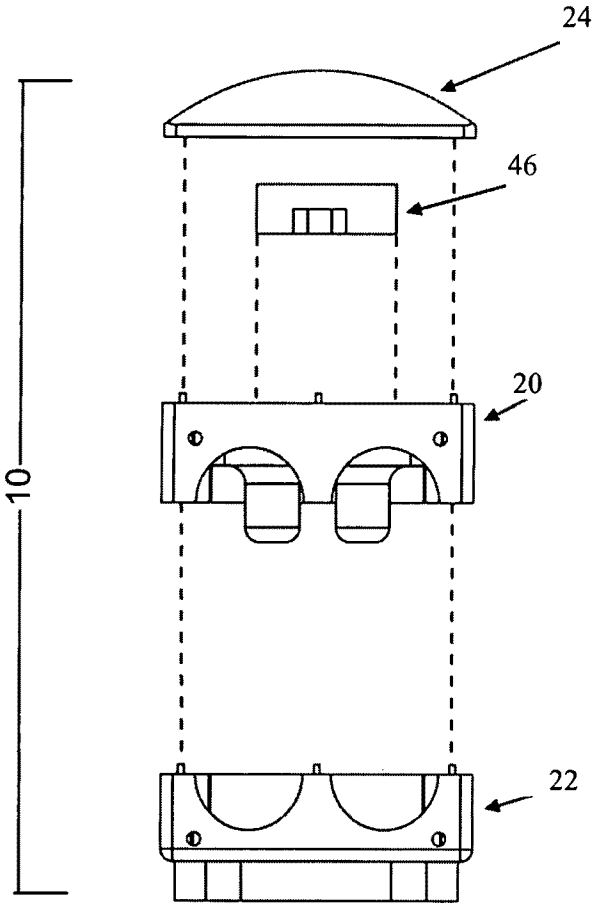
FIG. 6 is an exploded view of a fuel injection conversion body from the front.

With reference to FIG. 5, air is drawn into the plenum 11 via one or more intake apertures 26 through a suitable throttle body 100 (see FIG. 10) such that intake air is drawn into the plenum 11 under the control of the throttle valve (obscured within throttle body 100). Intake apertures 26 are, in the preferred embodiment, formed in the front wall of the fuel injection conversion body 10 which defines the plenum 11, and may be partially defined by the front section of the lower housing 22 and partially by the front section of the upper housing 20, as seen in FIG. 6. The primary axis X (FIG. 5) of the intake apertures 26 in this configuration is in the horizontal plane and is generally parallel to the engine crankshaft in a longitudinally mounted engine (and consequently perpendicular to the crankshaft in a transversely mounted engine). The intake apertures 26 are, in the depicted embodiment defined within the upper and lower housings 20, 22.

The number, size and shape of apertures 26 are selected to correspond to or cooperate with the number and shape of barrels or bores in the selected throttle body 100. The throttle body 100 may be attached by machine screws. A gasket may be employed to seal the connection between the throttle body 100 and the fuel injection conversion body 10. To accommodate the engine bay characteristics of certain vehicle/engine combinations, the intake apertures 26 may be successfully positioned on the side wall of the plenum with only minimal, if any, decrease in performance.

The primary axis Y of the exhaust aperture 28 in the depicted embodiment (see FIG. 5) is vertical. Thus the angle "a" between the primary axis of the intake aperture 26 and the primary axis of the fuel/air exhaust aperture 28 is 90 degrees, with air entering the engine intake manifold perpendicular to the engine crank shaft. In an alternate embodiment of the invention the primary axis of the exhaust aperture may be in the vertical longitudinal plane but at an angle "a" greater than 90 degrees (obtuse) to the primary axis of the intake aperture. The obtuse angle offset configuration between air intake apertures 26 and fuel/air exhaust aperture 28 permits installation of the plenum assembly 10 without the need for a hood bulge or other modification to the vehicle body work in many instances, as would be required to permit installation of a purely linear system. As angle a is increased, axis X is retained in the horizontal plane such that the intake apertures in the depicted embodiment are shifted forward and down in relation to the intake manifold, so as not to interfere with the existing coachwork, and the air plenum 11 must be extended along axis Y. The effective area of the exhaust aperture 28 is reduced as is the area within the fuel system bay (described below) in which to mount and align the fuel injectors. In practice as angle "a" approaches 140 degrees the flow restriction and geometry detrimentally effect performance.

With combined reference to FIGS. 4, 5, 6 and 7, fuel injection conversion body 10 is further comprised of an cover plate 24, together with upper housing 22 defining fuel system bay 42 (FIG. 5) for housing and concealing the fuel injectors and fuel rail 46. Fuel bay 42 is wholly contained within the fuel injection conversion body 10 but is sealed off from air plenum 11 by the floor 43 of the upper housing. Floor 43 is machined or otherwise provided with mounting bungs 40 for the seating conventional Bosch style or similar fuel injectors inserted from above. Bungs 40 are generally circular in form and stepped in profile to sealingly seat the injectors and are further provided with a central aperture 60 through the floor 43 dividing the fuel bay 42 and the air plenum 11 such that fuel from the injector spray tip is delivered to the air stream in the plenum 11 but no air is permitted to pass between the plenum 11 and fuel bay 42. The longitudinal axis of the injectors is substantially parallel to the longitudinal axis Y of the exhaust aperture 28 and thus, in the depicted embodiment, vertical. Where the primary axis of the exhaust aperture is non-vertical, as described above, the primary axis of the fuel injectors is altered to match such that the spray tip of the injectors generally targets the exhaust aperture directly along the primary axis. The housing elements of the injection conversion body 10 are altered accordingly.

Figure 4:
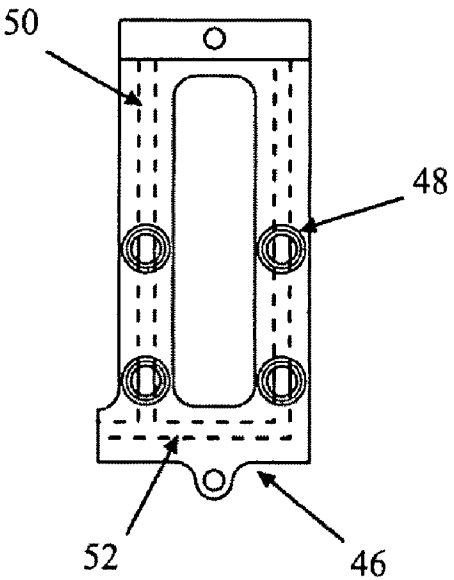
FIG. 4 is a view of the fuel rail internal to a fuel injection conversion body, from below.

FIG. 4 is a view of the fuel rail 46 which is internal to the injection conversion body 10. The fuel rail 46 is positioned above the fuel injectors within the fuel bay 42 such that each injector inlet nozzle is seated into a bore 48 in the fuel rail with an O-ring or the like. The fuel rail 46 is secured to upper housing 20 by machines screws to retain the injectors in their bungs 40 yet permit removal and service of the injectors (see FIG. 5, injectors omitted).

Figure 7:
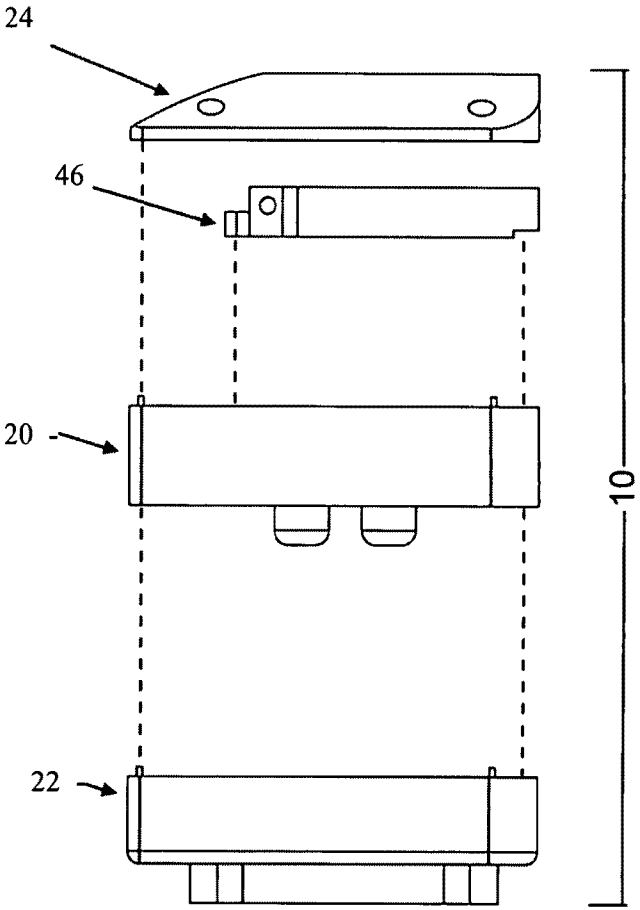
FIG. 7 is an exploded view of a fuel injection conversion body from the side.

The fuel rail 46 is formed as a circuitous tubular manifold defining a looping conduit that extends to and through the rear of the upper housing 24 of the injection conversion body 10 where pressurized fuel supply and return lines are provided to and from a fuel pump, fuel pressure regulator and fuel storage tank. High pressure fuel (40-60 psi) is provided to the injectors via two internal parallel fuel supply passages 50 machined into the fuel rail 46. The two internal parallel fuel supply passages 50 are tapped by bores 48, each bore 48 in the fuel rail connecting to one of the two internal parallel fuel supply passages 50 to provide fuel to the injectors. A fuel return passage 52 connects the fuel supply and returns unused fuel to be re-circulated. An air temperature sensor may be mounted beneath the fuel rail with a mounting plug 44 (FIG. 3) and sealed aperture through floor 43 into the air plenum to sample the incoming air. When the housing members 20, 22, 24 are assembled as depicted in FIGS. 6 and 7 the cover plate 24 on the top of the plenum assembly 10 conceals the fuel injectors and fuel rail 46 in the injector compartment from view, as observed in FIG. 10, providing a desirable aesthetic appearance and concealing the fact that the engine has been converted to a fuel injection system temperature.

In operation, air drawn is into the fuel injector plenum 11 on a horizontal axis via the intake apertures 26 by the low pressure vacuum created in the intake manifold during operation of the engine. The air is diverted downward toward the intake manifold by the confines of the injection conversion body 10 as it passes through the plenum 11 and exits the fuel/air exhaust opening 28. As the air exits the plenum 11 through restriction plate 29 it is thoroughly mixed with fuel spray from an injector pulse event, the vertically mounted injectors directing their spray directly into the high velocity airstream passing through the restriction plate 19 and into the intake manifold without contacting the plenum sidewalls or any other obstruction.

An engine control module may be installed within the fuel bay 42 of the injection conversion body 10. Relatively cooler intake air continuously drawn into the air plenum helps to keep components in the fuel plenum cool through conduction by the conversion body 10 which may be manufactured by machining from suitable metals such as aluminum, brass or steel. The plenum assembly may also be manufactured in components or as a single unit by injection molding from plastic materials of suitable strength and chemical or solvent resistance such as Delrin™, however with loss of much of the conductive cooling.

Having now fully set forth the preferred embodiments and certain modifications of the concept underlying the present invention, various other embodiments as well as certain variations and modifications thereto may obviously occur to those skilled in the art upon becoming familiar with the underlying concept. It is to be understood, therefore, that the invention may be practiced otherwise than as specifically set forth herein.

I claim:

1. A device for converting a carbureted internal combustion automobile engine having an existing air intake manifold to an electronically controlled fuel injected automobile engine comprising:

a housing;

an air plenum defined within said housing, said plenum having at least one intake aperture and an exhaust aperture, the primary axis of said intake aperture forming a non-straight angle with the primary axis of said exhaust aperture, and a fuel plenum separately defined within said housing from said air plenum, said fuel plenum being formed to conceal a plurality of fuel injectors retained therein, said injectors being retained so as to be in fluid communication with said air plenum, a fuel supply rail removably contained within said fuel plenum, said supply rail being in fluid communication with said injectors.

2. The device of claim 1 wherein said angle formed between the primary axis of said intake aperture and the primary axis of said exhaust aperture is 90 degrees.

3. The device of claim 1 wherein said angle formed between the primary axis of said intake aperture and the primary axis of said exhaust aperture is between 90 and 140 degrees.

4. The device of claim 1 wherein said housing further comprises a mounting flange encircling said exhaust aperture for sealed engagement with an engine intake manifold.

5. The device of claim 1 wherein the primary axis of the fuel injector is parallel to the primary axis of the exhaust aperture.

6. The device of claim 1 further comprising an exhaust restriction plate removably retained in said exhaust aperture so as to adjustably modify the fuel/air mixture characteristics of air exiting the air plenum.

7. The device of claim 6 wherein said restriction plate is comprised of a plurality of circular cylindrical bores in corresponding alignment with said fuel injectors, said bores having a flared diameter where the bore exits the air plenum.

8. The device of claim 6 wherein said restriction plate is comprised of a plurality of frusto-conical cylindrical bores in corresponding alignment with said fuel injectors.

9. The device of claim 1 further comprising an air temperature sensor mounting port between said air plenum and said fuel plenum.

* * * * *